United States Patent [19]

van Duynhoven

[11] 3,963,229

[45] June 15, 1976

[54] DEVICE FOR MANIPULATING YARNS

[75] Inventor: Adrianus Henricus van Duynhoven, Deurne, Netherlands

[73] Assignee: Ruti-Te Strake B.V., Deurne, Netherlands

[22] Filed: Dec. 20, 1973

[21] Appl. No.: 426,798

[30] Foreign Application Priority Data

Dec. 22, 1972 Netherlands ..... 7217620

[52] U.S. Cl. ..... 269/8; 83/452; 83/577

[51] Int. Cl.[2] ..... B25B 11/00; B26D 7/02

[58] Field of Search ..... 269/8; 83/575, 452, 83/577

[56] References Cited

UNITED STATES PATENTS

| | | | |
|---|---|---|---|
| 2,421,716 | 6/1947 | Rose | 269/8 X |
| 2,520,537 | 8/1950 | Forman | 83/577 X |
| 3,322,013 | 5/1967 | Felix | 83/575 X |
| 3,554,068 | 1/1971 | Schwartz | 83/575 X |

*Primary Examiner*—Frank T. Yost
*Attorney, Agent, or Firm*—Marshall & Yeasting

[57] ABSTRACT

A device for manipulating yarns, comprises a part movable between an operative and an inoperative position, which cooperates with an electric coil according to the principle of "magnetic pressure".

1 Claim, 1 Drawing Figure

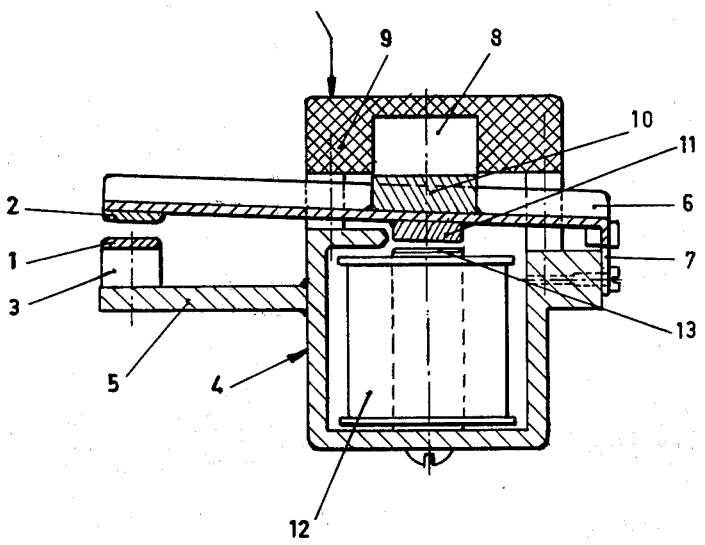
9
8
10
11
2
6
1
7
3
13
5
4
12

DEVICE FOR MANIPULATING YARNS

BACKGROUND OF THE INVENTION

The invention relates to a device for manipulating yarns. By manipulating in the sense of the invention should be understood the carrying out of actions such as clamping or imparting mechanical pulses to the yarn, as in cutting off and for a short time withdrawing or pushing a piece of yarn from its path.

Generally the yarn velocities and thereby the production speeds in weaving machines and other yarn textile machines are highly dependent on the velocities at which the above indicated actions may be carried out.

SUMMARY OF THE INVENTION

According to the invention actions of the kind under review may be carried out substantially more quickly than heretofore by means of a device characterized in that the operative part thereof cooperates with an electric coil according to the principle of "magnetic pressure". In accordance with the principle of magnetic pressure, if one positions a coil, e.g. coiled into a flat spiral, at a short distance from a metal disc and sends a current pulse through the coil, eddy currents are induced in the metal disc which result in a relatively large acceleration force of short duration, directed away from the coil.

The application of this principle in the device according to the invention means therefore that the operative part of the device comprises a disc of material suitable for the induction of eddy currents, which is situated at short distance from the electric coil, so that when a current pulse is supplied to the coil, e.g. by a control assembly which is part of a weaving machine or other textile machine, the operative part with the disc belonging thereto is moved away from the coil with a relatively large acceleration force.

For several actions this acceleration force of short duration may be sufficient to cause the operative part to carry out the desired action. This operative part may constitute the movable knife blade in a cutting device, which blade may carry out the desired cutting movement relative to a stationary knife as a result of the acceleration force of short duration.

Likewise the operative part may be a finger or needle which may carry out a quick movement under the influence of the acceleration force of short duration, against a return force acting thereon, in order to give a movement pulse to a thread.

With actions such as clamping it is important that the operative part, in this case a movable clamping jaw, not only be quickly brought into the closing position, but also remain thereafter in the closing position during a certain time. Therefore there has to be provided a keeping function in the device according to the invention for carrying out actions of this kind.

A practical embodiment of the device according to the invention for this purpose is characterized in that the operative part also cooperates with an electromagnet coil which keeps, when energized, the operative part in its operative position.

Thus according to the invention very quickly and accurately operating yarn clamps, yarn cutting devices and similar devices may be obtained, which may contribute largely to the efforts for increasing the production speeds of textile machines, such as the weaving speed of weaving machines.

BRIEF DESCRIPTION OF THE DRAWING

The drawing is a central vertical section of a yarn clamp embodying the invention.

DESCRIPTION OF THE PREFERRED EMBODIMENT

The yarn clamp shown in the drawing comprises a stationary and a movable clamping jaw 1 and 2 respectively. The stationary clamping jaw 1 is secured through a rubber block 3 to a projecting part 5 of a housing 4 to be mounted stationary, e.g. on the frame of a weaving machine.

The movable clamping jaw 2 is secured to the one end of a lever 6, preferably made from a light material, such as aluminum, which is pivotally connected at its other end to the housing 4. The pivot connection is constituted by a leaf spring 7 which is somewhat biased, namely so that the spring tends to rotate the lever clockwise as seen in the drawing.

An electric coil, indicated with the reference number 8, is preferably coiled to the shape of a flat spiral and is received in a bridge piece 9, preferably made of plastic, extending over the housing 4 and secured thereto. The lever 6 extends below the bridge piece 9 and comprises at the position of the coil 8 a disc 10, e.g. of aluminum, which is suitable for induction therein of eddy currents when a current pulse is sent through the coil 8. In the open position of the yarn clamp, shown in the drawing, the lever 6 with the disc 10 is kept by the biased spring 7 against the coil 8.

At its lower side the lever 6 supports a second disc or block 11 of ferromagnetic material, which cooperates with the armature 13 of an electromagnet 12 mounted in the housing 4.

The described thread clamp operates as follows:

A current pulse supplied to the coil 8 results in that a large downwardly directed acceleration force is imparted to the disc 10, which force moves the lever 6 very quickly to the closing position. If now simultaneously with the energizing the coil 8 the electromagnet 12 is energized, the lever 6 is thereafter kept in its closed position during the energization time interval of the electromagnet in that the ferromagnetic disc 11 is attracted by the electromagnet armature 13.

It will be easily seen that e.g. a cutting device, operating according to the same principle, in which the lever 6 could be considered as the movable knife and the stationary clamping jaw 1 as the stationary knife, could be lacking of the electromagnet 12 and the ferromagnetic disc 11 at the lower side of the lever 6, since in this case the movement of short duration of the movable knife would be sufficient in itself for carrying out the desired cutting action.

I claim:

1. A device for high speed manipulation of yarn, comprising a movable yarn-clamping jaw that is movably mounted for movement between an inoperative position and an operative position, wherein the improvement comprises an electric coil mounted adjacent to the inoperative position of said jaw, and a body of conducting, nonmagnetic material mounted on said jaw which approaches most closely to said coil when said jaw is in its inoperative positive, and in which eddy currents are induced by a pulse of current passed through said coil, to repel said jaw away from said coil toward its operative position, said yarn-clamping jaw also carrying an armature of magnetic material, and an electromagnet coil being mounted in a position which is most closely approached by said armature when said jaw is in its operative position, and which when energized maintains said jaw in its operative position.

* * * * *